US006464378B1

(12) United States Patent
Reed et al.

(10) Patent No.: US 6,464,378 B1
(45) **Date of Patent: *Oct. 15, 2002**

(54) SELF-STANDING REFLECTOR FOR A LUMINAIRE AND METHOD OF MAKING SAME

(75) Inventors: Mark C. Reed, West Chester, OH (US); Jerry F. Fischer, West Chester, OH (US); James G. Vanden Eynden, Indian Springs, OH (US); Andrew J. Bankemper, California, KY (US); Robert E. Kaeser, Cincinnati, OH (US)

(73) Assignee: LSI Industries Inc., Cincinnati, OH (US)

( * ) Notice: Subject to any disclaimer, the term of this patent is extended or adjusted under 35 U.S.C. 154(b) by 16 days.

This patent is subject to a terminal disclaimer.

(21) Appl. No.: 09/723,924

(22) Filed: Nov. 28, 2000

Related U.S. Application Data

(63) Continuation-in-part of application No. 09/211,148, filed on Dec. 14, 1998, now Pat. No. 6,152,579.

(51) Int. Cl.[7] ..... F21V 7/10
(52) U.S. Cl. ..... 362/320; 362/297; 362/346
(58) Field of Search ..... 362/298, 320, 362/297, 346, 350, 347, 341, 296

(56) References Cited

U.S. PATENT DOCUMENTS

| | | | | |
|---|---|---|---|---|
| 1,547,026 A | | 7/1925 | Canney | |
| 1,873,310 A | | 8/1932 | Doane | |
| 2,907,873 A | | 10/1959 | Smith | |
| 4,028,542 A | | 6/1977 | McReynolds, Jr. | |
| 4,412,276 A | | 10/1983 | Blinow | |
| 4,428,030 A | | 1/1984 | Baliozian | |
| 4,616,293 A | | 10/1986 | Baliozian | |
| 4,855,884 A | | 8/1989 | Richardson | |
| 5,508,902 A | | 4/1996 | Shoemaker | |
| 5,568,680 A | | 10/1996 | Parker | |
| 5,571,280 A | | 11/1996 | Lehrer | |
| 5,938,317 A | | 8/1999 | Thorton | |
| 6,152,579 A | * | 11/2000 | Reed et al. | 362/297 |

* cited by examiner

*Primary Examiner*—Stephen Husar
*Assistant Examiner*—John Anthony Ward
(74) *Attorney, Agent, or Firm*—Wood, Herron & Evans, LLP

(57) ABSTRACT

A luminaire reflector formed from at least one sheet of reflective material is folded and curved by hand to form a self-standing reflector having a predetermined three-dimensional reflector shape. Each sheet of reflective material includes integral panels that are joined to adjacent panels through fold lines that allow the panels to be folded by hand. The panels have free edges that are folded and/or curved into abutting relationship. The panels include locking members and positioning tabs formed adjacent the free edges to retain the reflector in a predetermined three-dimensional reflector shape. Methods of making a self-standing reflector for a luminaire are also disclosed.

34 Claims, 9 Drawing Sheets

SELF-STANDING REFLECTOR FOR A LUMINAIRE AND METHOD OF MAKING SAME

The present application is a continuation-in-part of co-pending U.S. Ser. No. 09/211,148, filed Dec. 14, 1998, now U.S. Pat. No. 6,152,579, the disclosure of which is hereby incorporated herein by reference in its entirety.

FIELD OF THE INVENTION

The present invention relates generally to luminaires and, more particularly, to three-dimensional reflectors for such luminaires to produce a light distribution pattern in an area to be illuminated, and its method of manufacture.

BACKGROUND OF THE INVENTION

Luminaires are designed to produce a predetermined light distribution pattern in an area to be illuminated, such as in parking lots, along roadways, or in other areas requiring broad illumination of a surface. Luminaires generally include a housing or enclosure that supports a light socket, a high-intensity light source mounted in the socket, a light reflector mounted behind and/or around the light source and other electrical hardware necessary to energize the light source. The illumination pattern created by the luminaire is generally defined by the shape of the light reflector mounted in the luminaire, as well as the position of the light source relative to the reflector. The reflector may form a partial enclosure about the source of light so that the inner surfaces of the reflector direct reflected light through an opening formed in a lower portion of the luminaire housing.

In the past, one-piece reflectors have been fabricated by molding or otherwise forming a flat piece of metal or other suitable reflective material into a desired reflector shape. The reflector may be formed by forming a sheet of reflective material between male and female dies that have cooperating three-dimensional shapes defining the reflector shape. Alternatively, the reflector may be formed by hydroforming the sheet of reflective material over a three-dimensional male form that defines the reflector shape as is well known in the art. In another method, the reflector may be spun by contouring a sheet of reflective material over a revolving male mandrel with a pressure tool to conform the sheet to the shape of the mandrel. In yet another method of fabricating reflectors, the sheet of reflective material may be formed using a press brake or other forming machine that successively bends the sheet along predetermined fold lines into a series of planar facets that approximate a desired curved surface of the reflector.

Reflectors have also been fabricated from multiple sheets of reflective material that have been individually shaped and formed and then assembled together to form a reflector shape. The individual parts of the multi-component reflector have either been joined together through fastening hardware or other suitable structures prior to mounting the assembled reflector in a luminaire housing, or the reflector components have been mounted individually within the luminaire housing to form the three-dimensional reflector shape within the housing.

Forming the desired reflector shape using cooperating male and female dies has a drawback that the dies are relatively expensive to make and are difficult to modify if changes in the reflector shape are required. Moreover, the sheet of material may not draw easily and consistently to achieve the necessary depth and shape of the reflector during deep drawing formations. Hydroforming or spinning of reflectors have the disadvantage that most reflector manufacturers do not have hydroforming or spinning capabilities in-house and must rely on outside contractors with that capability to form the reflectors. Another disadvantage of reflectors machine-formed into three-dimensional curved shapes, as by die-drawing, hydroforming or spinning, is that the reflective finish on the reflector must be applied in secondary operations, usually by polishing and anodizing. Using a press brake to successively bend the sheet of material has the drawback that many manufacturing steps or forming operations are required to form the many planar facets that define the reflector shape. Additionally, the series of planar facets formed by press brake forming operations do not provide a substantially continuous curve on the inner reflective surfaces of the sheet panels that may be required to create a certain light distribution pattern. It will also be appreciated by those skilled in the art that after reflectors are formed into their three-dimensional shapes through the methods above, significant warehouse space may be required to store the many reflector shapes that may be used. Lastly, multi-part reflectors suffer from the disadvantage that they may require storage and inventory of many different reflector parts and fastening hardware, as well as significant off-line subassembly prior to final fabrication of the three-dimensional reflector.

Thus, there is a need for a self-standing reflector and method of making same that allows the reflector to be formed relatively easily and consistently from at least one sheet of reflective material.

There is also a need for a self-standing reflector and method of making that allows the reflector to be rapidly formed from at least one sheet of reflective material in relatively few manufacturing steps or forming operations.

There is also a need for a self-standing reflector and method of making same that allows the reflector to be formed from at least one sheet of reflective material relatively quickly as needed at the time and place of luminaire fabrication, thereby reducing the warehouse space necessary to store many different reflector shapes.

There is yet also a need for a self-standing reflector and method of making same that allows the reflector to be formed from at least one sheet of reflective material with substantially continuous curves on the inner reflective surfaces of the reflector and retained in a predetermined three-dimensional shape.

SUMMARY OF THE INVENTION

The present invention overcomes the foregoing and other shortcomings and drawbacks of luminaire reflectors and methods heretofore known. While the invention will be described in connection with certain embodiments, it will be understood that the invention is not limited to these embodiments. On the contrary, the invention includes all alternatives, modifications and equivalents as may be included within the spirit and scope of the present invention.

In accordance with the principles of the present invention, a self-standing reflector and method of making same is provided for forming a reflector from at least one sheet of reflective material. Each sheet of material is preferably formed in a single hit die press to form a series of integral reflective panels. The sheets of reflective material are adapted to be joined together so that the panels may be folded by hand into edge-abutting relationship to define a predetermined three-dimensional reflector shape. At least some of the panels may include substantially non-linear free edges that abut substantially non-linear free edges of abutting panels. Each sheet of material is relatively thin to allow one or more of the panels to be curved by hand to define curved reflective surfaces. In this way, the abutting curved panels form a substantially contiguous curved reflective surface within the reflector.

The panels are preferably joined to adjacent panels through perforated fold lines that preferably include a series of elongated slots formed through the thickness of the sheet. The fold lines are perforated to allow the sheet of material to be easily folded by hand along the fold line to form the desired three-dimensional reflector shape.

Alternatively, a backing member made of relatively stiff sheet material may be attached to or otherwise operatively engaged with the sheet of reflective material. The backing member and sheet are positioned relative to each other so that at least one elongated edge of the backing member is coincident with a predetermined fold line in the sheet. Upon folding of a panel by hand, the edge of the backing member defines a consistent line of bending in the sheet along the predetermined fold line.

In an alternative embodiment of the present invention, elongated notches are provided in the sheet to define at least one generally narrow connecting web associated with at least one of the panels. The connecting web defines a consistent line of bending in the sheet that is coincident with a predetermined fold line.

The panels may include locking members formed proximate the panel edges that cooperate to provide locking engagement between abutting panel edges for retaining the reflector in its three-dimensional reflector shape. The locking members may include a locking tab extending from one panel edge that is inserted into a locking slot formed adjacent an abutting panel edge to form a locking engagement between the abutting panels. Positioning tabs may be formed to extend outwardly from free edges of the panels. The positioning tabs of one panel overlie an abutting panel to maintain abutting relationship of the abutting panel edges.

Thus, it will be appreciated that the reflector of the present invention may be fabricated in one or more hits in a die press that is relatively easy to modify in the event changes in the reflector shape are required. The reflector may be stored flat until needed, and readily assembled by hand for installation in a luminaire at the time and place of luminaire assembly, thereby requiring less warehouse space to store the various reflector shapes than would be required for storing preformed three-dimensional reflectors. It will also be appreciated that the reflector of the present invention provides a three-dimensional reflector shape that may be easily and consistently formed from at least one sheet of reflective material without a press brake or similar forming machine.

The above and other objects and advantages of the present invention shall be made apparent from the accompanying drawings and the description thereof.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION OF SPECIFIC EMBODIMENTS

Figures 1, 1A:
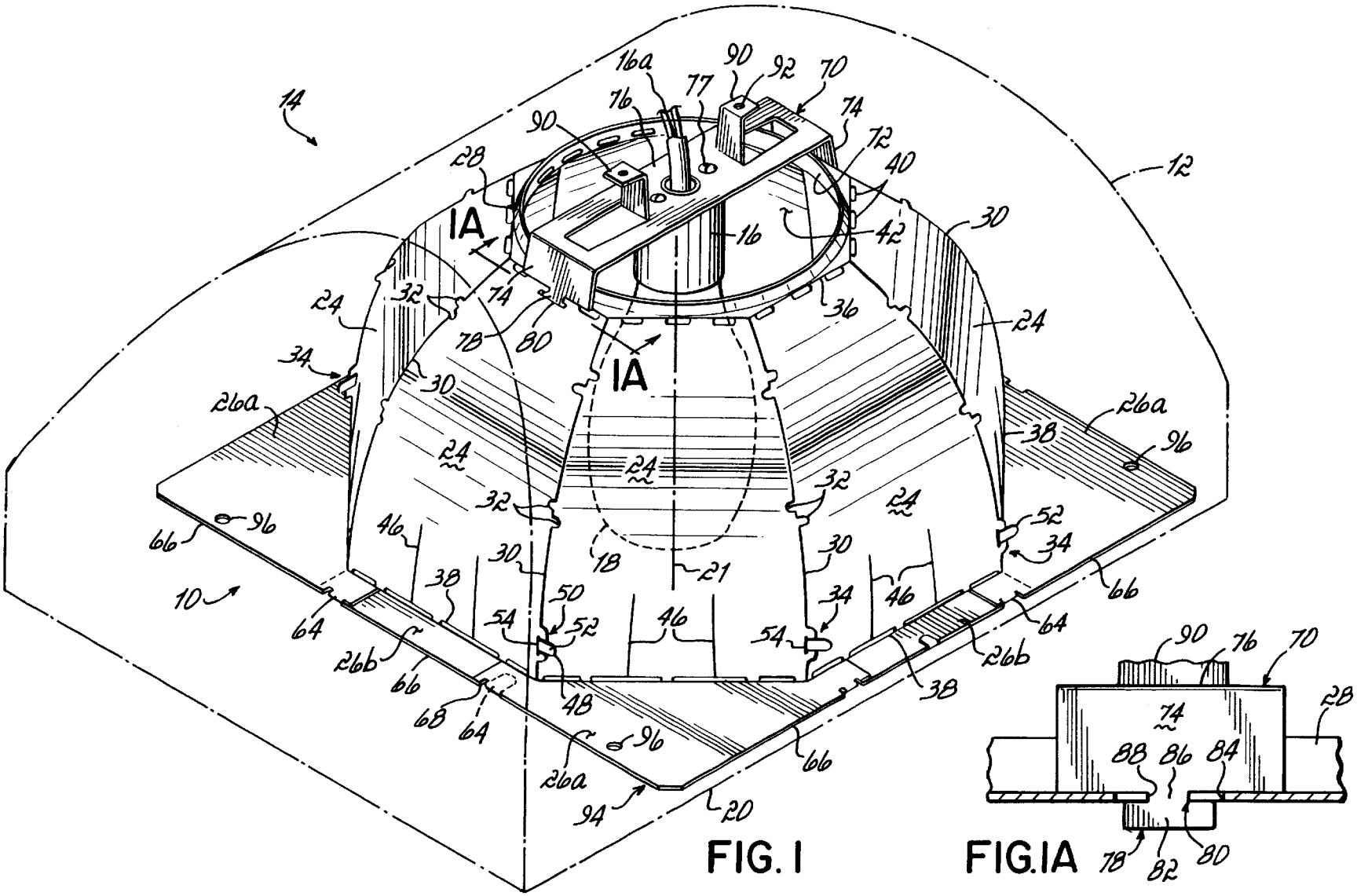
FIG. 1 is a perspective view illustrating one embodiment of a self-standing reflector assembled in accordance with the principles of the present invention and installed in a luminaire housing.
FIG. 1A is an enlarged cross-sectional view taken along line 1A—1A in FIG. 1.

With reference to the figures, and to FIG. 1 in particular, one embodiment of a self-standing reflector 10 assembled in accordance with the principles of the present invention is shown installed in a luminaire housing 12 (shown in phantom) of a luminaire assembly 14. Luminaire assembly 14 includes the enclosed reflector 10, a light source socket 16 disposed within the reflector 10, and a light source 18 mounted in the socket 16 for emitting light from an opening 20 formed in the housing 12. A lens (not shown) may be mounted on the underside of the luminaire housing 12 to cover the opening 20. The reflector 10 is positioned behind and about the light source 18 to direct reflected light in a predetermined light distribution pattern through the opening 20.

In accordance with one aspect of the present invention, the light source 18 is mounted in socket 16 with its longitudinal axis 21 aligned generally along an optical axis of the reflector 10 to provide a "Type V" illumination pattern on a roadway or other surface to be illuminated. A "Type V" light distribution pattern has circular symmetry, i.e., the illumination is essentially the same at all lateral angles around the optical axis of the reflector of the luminaire at a given distance from the light source. As those of ordinary skill in the art will appreciate, luminaire housing 12 is preferably an enclosure that may be formed in a variety of shapes and sizes, and is typically mounted on a pole or other supporting structure to raise the luminaire assembly 14 far enough above the ground to provide a broad light distribution pattern on the ground. While not shown, it will be appreciated that luminaire assembly 14 may also include a transformer, capacitor or other electrical hardware (not shown) mounted in luminaire housing 12 and connected to a source of power (not shown) for energizing the light source 18 via suitable wiring 16*a* (FIG. 1) connected to socket 16.

With reference to FIGS. 1–5, reflector 10 is preferably formed from a unitary single sheet of reflective material 22 (FIG. 2) that may be die cut in a die press operation or otherwise formed using methods known in the art. The sheet of reflective material 22 may be polished anodized aluminum (also known as "specular aluminum"), semi-specular aluminum, or other reflective material that has the desired reflective and other structural properties for a reflector. The sheet 22 may have a thickness of about 0.020 in. to permit it to be folded and curved by hand into a desired three-dimensional reflector shape, as will be described in greater detail below. The sheet of reflective material 22 is adapted to be folded and curved by hand at the factory or at the installation site into the self-standing reflector 10 which may be then mounted into the luminaire housing 12. As will be described in detail below, it is contemplated that one or more sheets of reflective material may be joined together and folded by hand to form a desired three-dimensional reflector shape in accordance with its principle of the present invention.

Figure 2:
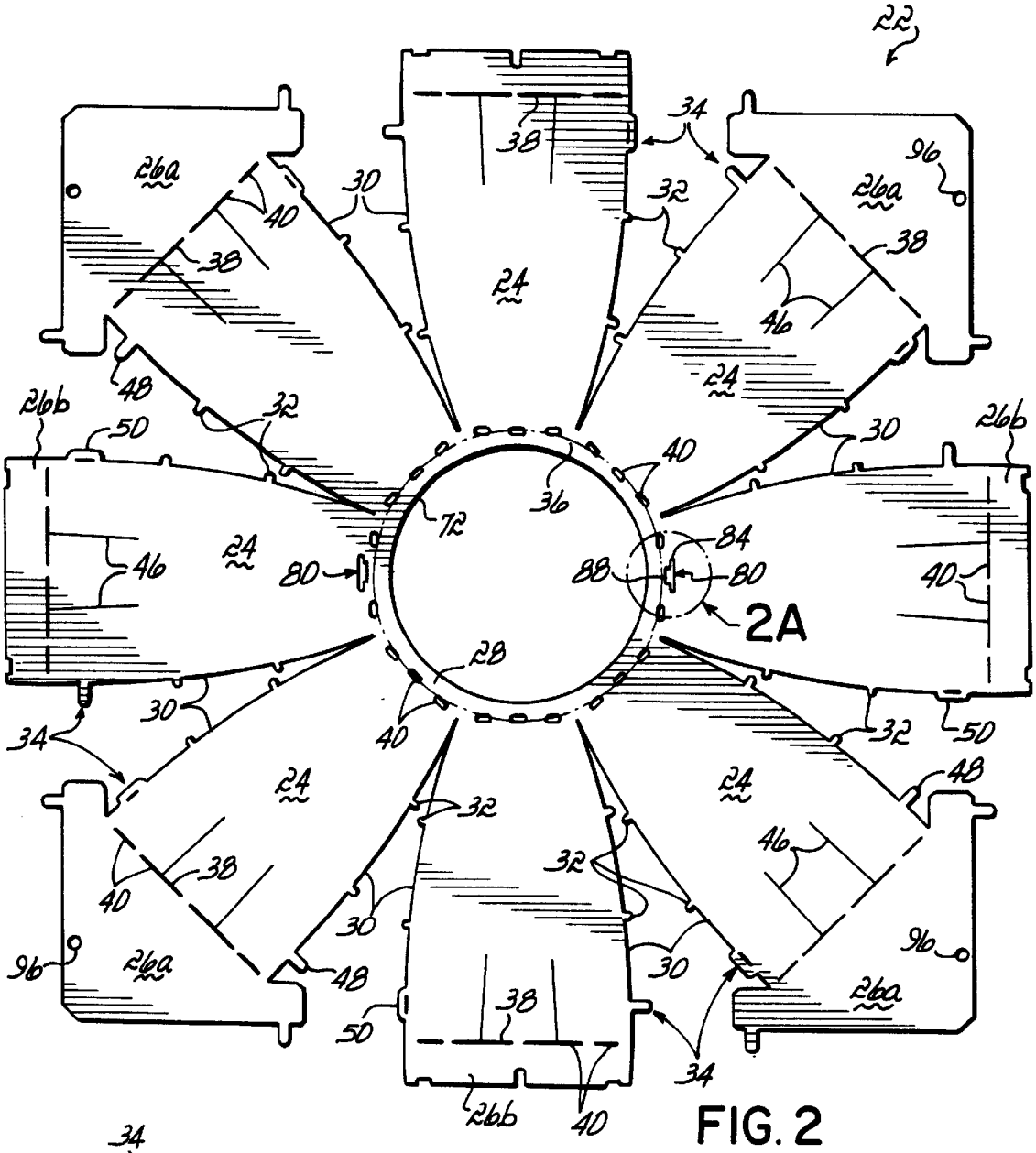
FIG. 2 is a top plan view of a sheet of reflective material that has been formed for making the assembled reflector illustrated in FIG. 1.

In accordance with one aspect of the present invention as best understood with reference to FIG. 2, the sheet of reflective material 22 includes integral panels 24, mounting flanges 26*a* and 26*b*, and collar 28 that generally lie in a common plane after formation of the sheet 22 from the die press or other forming operation. Each panel 24 is formed with a pair of spaced elongated, substantially non-linear free edges 30 that are adapted to abut a non-linear free edge 30 of an abutting panel when the panels 24 are folded to form the assembled reflector 10 as shown in FIG. 1. As set forth herein, the term "substantially non-linear" is used to describe that the free edges 30 of panels 24 are formed with generally continuous curves that are not defined by a series of connected linear segments. The panels 24 include positioning tabs 32 extending outwardly from the free edges 30 to aid in aligning abutting panel edges as described in greater detail below with reference to FIG. 4. The panels 24 also include locking members 34 formed proximate the free edges 30 to form an engagement between abutting panels as described in greater detail below with reference to FIGS. 1, 4, 5, 5A and 5B.

The panels 24 are joined to the collar 28 through a fold line 36, and the mounting flanges 26*a* and 26*b* are joined to respective panels 24 through fold lines 38. Preferably, fold lines 36 and 38 include a series of elongated apertures 40 formed through the thickness of sheet 22 to permit folding of the sheet 22 along the fold lines 36 and 38 by hand. While a series of elongated apertures 40 are illustrated in a preferred embodiment for forming fold lines 36 and 38, it will be appreciated by those of ordinary skill in the art that fold lines 36 and 38 may be formed by smaller circular apertures, slits, score lines or other bendable or yielding structures formed in the unitary, single-piece sheet 22 without departing from the spirit and scope of the present invention. While pre-formed fold lines are preferred, it is contemplated that other structures formed into the sheet of reflective material, or attached thereto, are possible to define predetermined fold lines or lines of bending in the sheet of reflective material upon folding of the sheet by hand as will be described in detail below.

Figures 2A, 3:
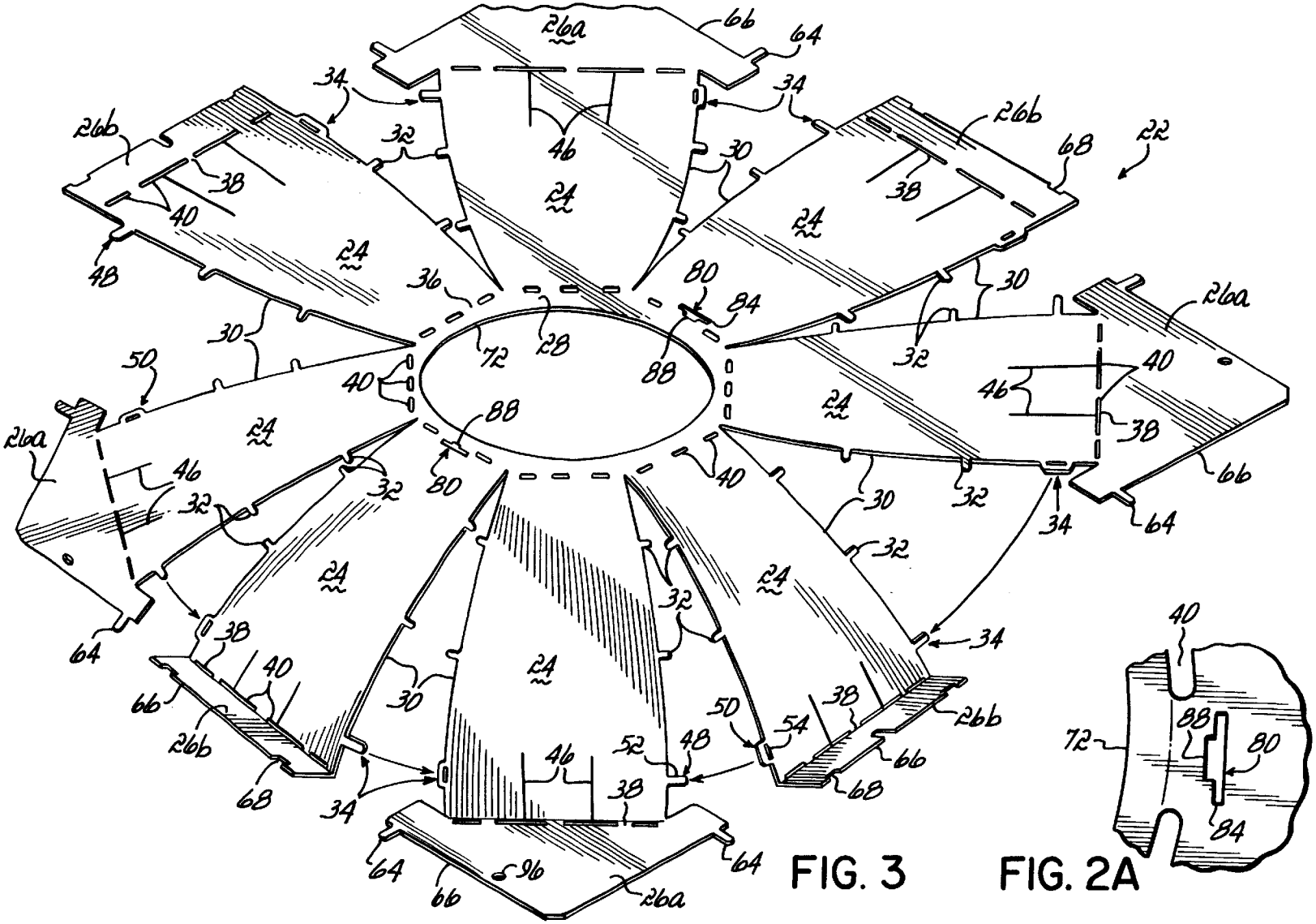
FIG. 2A is an enlargement of the circled area of FIG. 2.
FIG. 3 is a perspective view showing the sheet of reflective material illustrated in FIG. 2 being assembled to form the reflector illustrated in FIG. 1.
Figure 4:
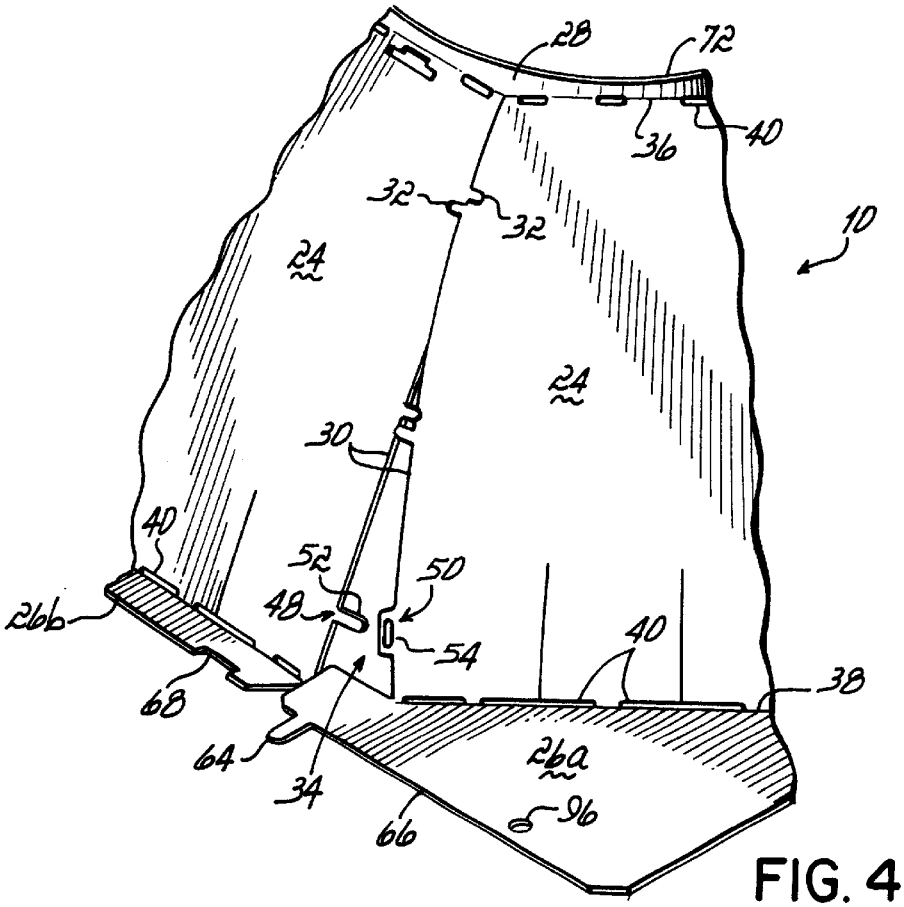
FIG. 4 is a partial perspective view of the reflector illustrated in FIG. 1, showing abutting free edges of a pair of abutting panels.

As best understood with reference to FIG. 3, assembly of reflector 10 from the sheet of reflective material 22 is shown in accordance with the principles of the present invention. Each of the panels 24 is adapted to be folded by hand downwardly and inwardly along fold line 36, and also curved by hand to form curved panels with inside curved reflective surfaces as described in detail below. The mounting flanges 26*a* and 26*b* are adapted to be folded by hand upwardly along fold lines 38. The collar 28 is adapted to be folded by hand upwardly along fold line 36, and may include slits (not shown) that permit collar 28 to be folded upwardly. As the panels 24 are brought into abutting relationship as shown in FIG. 4 to abut free edges 30, the panels are gently curved by hand to form curved reflective surfaces on the inside surface of reflector 10. In a preferred abutting relationship of panels 24, the positioning tabs 32 of one curved panel overlie the abutting margin of the adjacent curved panel to maintain abutting relationship of free edges 30. In this way, a substantially contiguous curved reflective surface 42 (FIG. 1) is formed within reflector 10 by the abutting curved panels 24. The panels 24 may include elongated upsets or deformations 46 formed generally parallel to the longitudinal axis 21 of the panels on inner surfaces thereof to modify the reflective pattern created by the panels 24.

As best understood with reference to FIGS. 1, 4, 5, 5A and 5B, the locking members 34 include a locking tab 48 formed proximate a free edge 30 of the panels 24. Confronting and in registry with the locking tabs 48 are locking slots 50 formed proximate a free edge 30 of abutting panels 24. As shown most clearly in FIG. 2, each panel 24 includes a locking tab 48 formed on one free edge 30 and a locking slot 50 formed on the opposite free edge 30. In accordance with one aspect of the invention as shown most clearly in FIGS. 1, 4 and 5, the locking tabs 48 are formed as planar tabs 52 extending outwardly from free edges 30 of the panels 24, while locking slots 50 are formed as slotted tabs 54 extending outwardly from free edges 30 of abutting panels 24. As the panels 24 are brought into abutting relationship, the locking tabs 48 of one panel 24 are inserted in the locking slots 50 of an abutting panel 24 and then folded backwardly to form a locking engagement between the abutting panels 24.

Figure 5A:
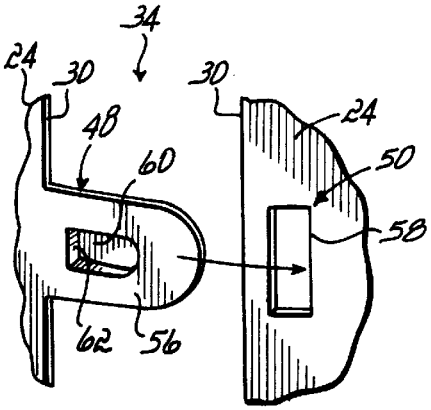
FIG. 5A is a partial perspective view illustrating an alternative embodiment of the locking mechanism to engage abutting panels.
Figure 5B:
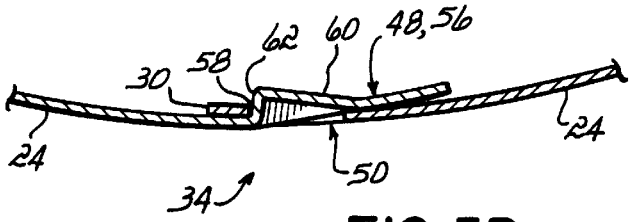
FIG. 5B is a partial cross-sectional view through the alternate locking mechanism shown in FIG. 5A, illustrating engagement of the locking mechanism shown in an engaged position in FIG. 5A.

Alternatively, as shown most clearly in FIGS. 5A and 5B, the locking tabs 48 are formed as detent tabs 56 extending outwardly from free edges 30 of the panels 24, while locking slots 50 are formed as slots 58 extending through the thickness of sheet 22 inwardly from free edges 30 of abutting panels 24. Detents 60 are stamped or otherwise formed in the tabs 56 to form an upset surface 62 extending below the tab 56. As the panels 24 are brought into abutting relationship, the locking tabs 48 of one panel 24 are received in the locking slots 50 of an abutting panel 24 with the upset surfaces 62 of the detent tabs 56 engaging the slots 58 to form a locking engagement between the abutting panels 24.

Figure 5:
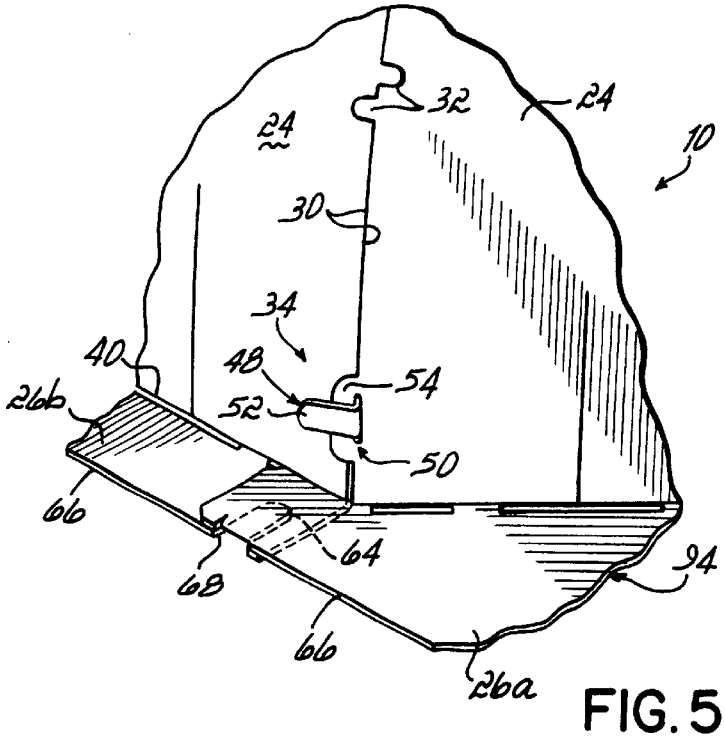
FIG. 5 is an enlarged partial perspective view illustrating one embodiment of a locking mechanism to engage abutting panels.

Additionally, as the panels 24 are brought into abutting relationship, the mounting flange 26*a* of one panel 24 may overlie the mounting flange 26*b* of an abutting panel 24 as shown most clearly in FIGS. 1, 4 and 5. Each of the overlying mounting flanges 26*a* includes a foldable tab 64 extending outwardly from a free edge 66 of the mounting flange, while the other underlying mounting flanges 26*b* include notches 68 formed on free edges 66 that confront and are in registry with the foldable tabs 64. As the panels 24 are brought into abutting relationship, the tabs 64 are folded about the notches 68 to capture a portion of the mounting flanges 26*b* between the folded tabs 64 and the overlying mounting flanges 26*a*. In this way, it will be appreciated that the locking members 34, foldable tabs 64 and notches 68 cooperate upon assembly of reflector 10 to retain the reflector 10 in its self-standing three-dimensional reflector shape. Those of ordinary skill in the art will appreciate that other locking structures and folding configurations are possible to form and retain the reflector 10 in its self-standing reflector shape without departing from the spirit and scope of the present invention.

With further reference to FIG. 1, luminaire assembly 14 includes a bracket 70 for supporting the light source socket 16 within reflector 10 so that the socket 16 and light source 18 extend through a circular aperture 72 (FIGS. 1 and 2) formed in the sheet of reflective material 22 with the longitudinal axis 21 of source 18 aligned generally along the optical axis of reflector 10. Bracket 70 is channel shaped and includes opposite spring flanges 74 that depend from a central web 76. The socket 16 is mounted to central web 76 through suitable fasteners 77 so that it extends through the aperture 72 into the interior of reflector 10.

As best understood with reference to FIG. 1A, each spring flange 74 terminates in a T-shaped projection 78 that cooperates with a respective T-shaped notch 80 (FIGS. 1 and 2) formed in a pair of opposite panels 24. To mount the bracket 70 on the reflector 10, the spring flanges 74 are biased apart by hand so that enlarged heads 82 of the T-shaped projections 78 register with enlarged slots 84 of the T-shaped notches 80 (FIGS. 1A, 2A and 3). After the T-shaped projections 78 are inserted into the T-shaped notches 80, the spring flanges 74 are released to allow a narrow neck 86 of the T-shaped projections 78 to travel into narrow slots 88 of the T-shaped notches 80 (FIG. 1A). In this position, the enlarged heads 82 of the T-shaped projections 78 are captured below a surface of the panels 24 as best understood with reference to FIG. 1A.

As best understood with reference to FIG. 1, the bracket 70 includes a pair of upstanding ears 90 extending upwardly from the central web 76 that allow the bracket 70 to be mounted to the luminaire housing 14 through suitable fasteners (not shown) extending through apertures 92 formed on the ears 90. The assembled reflector 10 is installed in luminaire housing 12 with the other necessary electrical hardware. The mounting flanges 26*a* and 26*b* of reflector 10 form a rectangular mounting platform 94 that includes apertures 96 for receiving suitable fasteners (not shown) to secure the reflector 10 within the luminaire housing 12.

Figure 7:
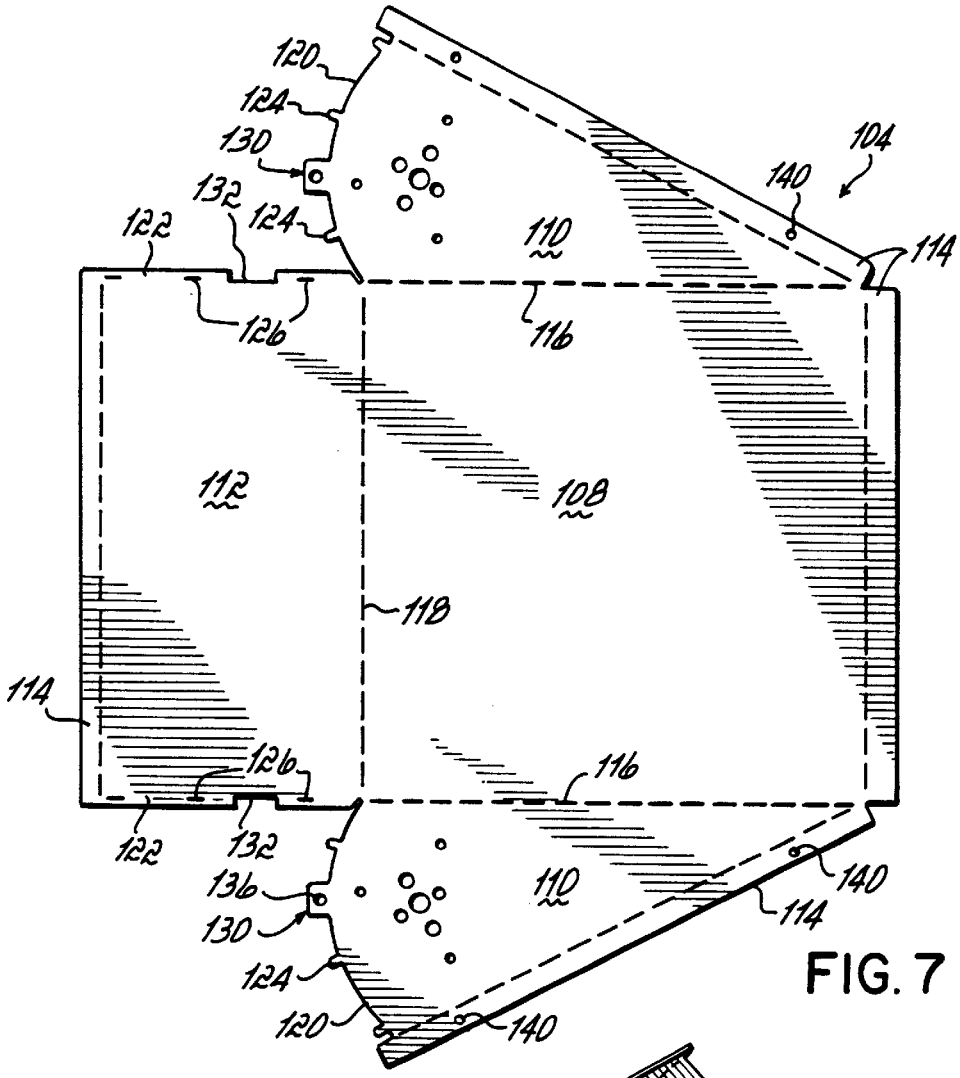
FIG. 7 is a top plan view of a sheet of reflective material that has been formed for making the assembled reflector illustrated in FIG. 6.
Figure 6:
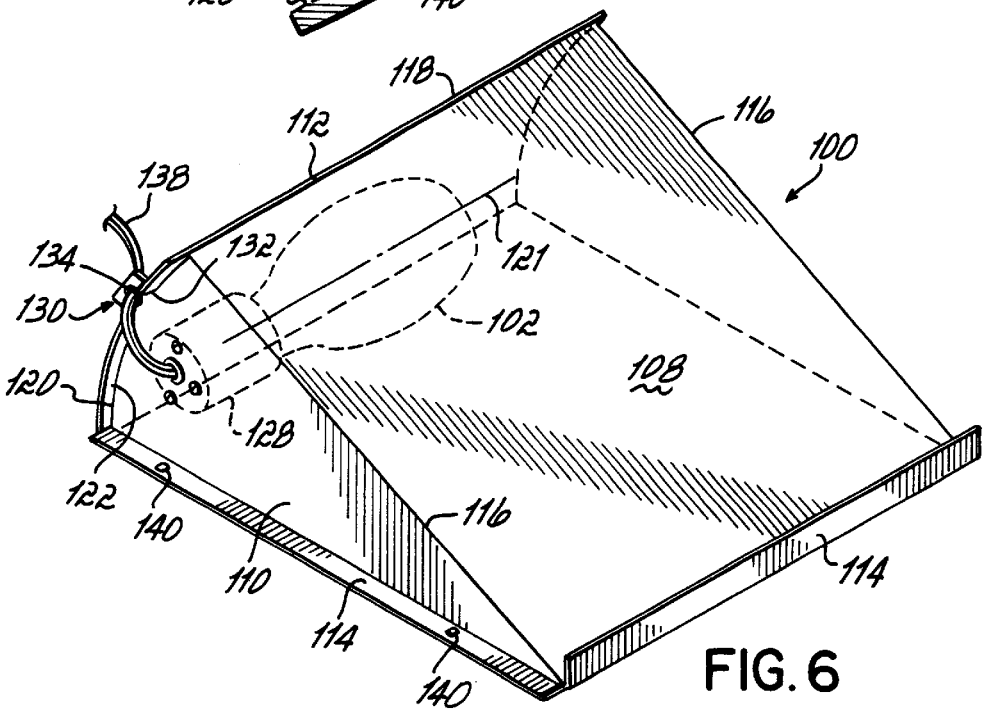
FIG. 6 is perspective view of an alternative reflector assembled in accordance with the principles of the present invention.

Referring now to FIGS. 6 and 7, an alternative embodiment of a self-standing reflector 100 is shown in accordance with the principles of the present invention. Reflector 100 is also partially enclosed about a light source 102, and is particularly adapted to provide a "forward throw" light distribution pattern in an area to be illuminated. Reflector 100 is formed from a sheet of reflective material 104 (FIG. 7) through a similar process as described above with reference to reflector 10. Sheet 104 includes integral top panel 108, side panels 110, rear panel 112, and mounting flanges 114 that are adapted to be folded and curved by hand to form the assembled reflector 100 shown in FIG. 6.

The pair of side panels 110 are joined to the top panel 108 through fold lines 116 that are similar in formation to the fold lines 36 and 38 described in detail above to allow the side panels 110 to be folded by hand downwardly along the fold lines 116. Rear panel 112 is joined to top panel 108 through a fold line 118 that permits rear panel 112 to be folded and curved by hand downwardly along the fold line 118 into abutting relationship with the side panels 110. Each side panel 110 includes a substantially non-linear free edge 120 that is adapted to abut adjacent a free edge 122 of curved rear panel 112 when reflector 100 has been assembled. Locking tabs 124 are formed on the free edges 120 of the side panels 110 to engage locking slots 126 formed adjacent free edges 122 of curved rear panel 112.

A light socket 128 is mounted to one of the side panels 110 with its longitudinal axis 121 aligned generally perpendicular to the folded side panels 110. Each side panel 110 includes an elongated, apertured tab 130 that extends through a notch 132 formed on the free edges 120 of the curved rear panel 112. The tab 130 includes a grommet 134 mounted or formed in aperture 136 to protect a power cord 138 that extends from a power source (not shown) to the base of socket 128 as shown in FIG. 6. In its assembled shape, reflector 100 is self-standing and adapted to be mounted in a luminaire housing (not shown) through fasteners (not shown) extending through apertures 140 formed in mounting flanges 114.

Figure 8:
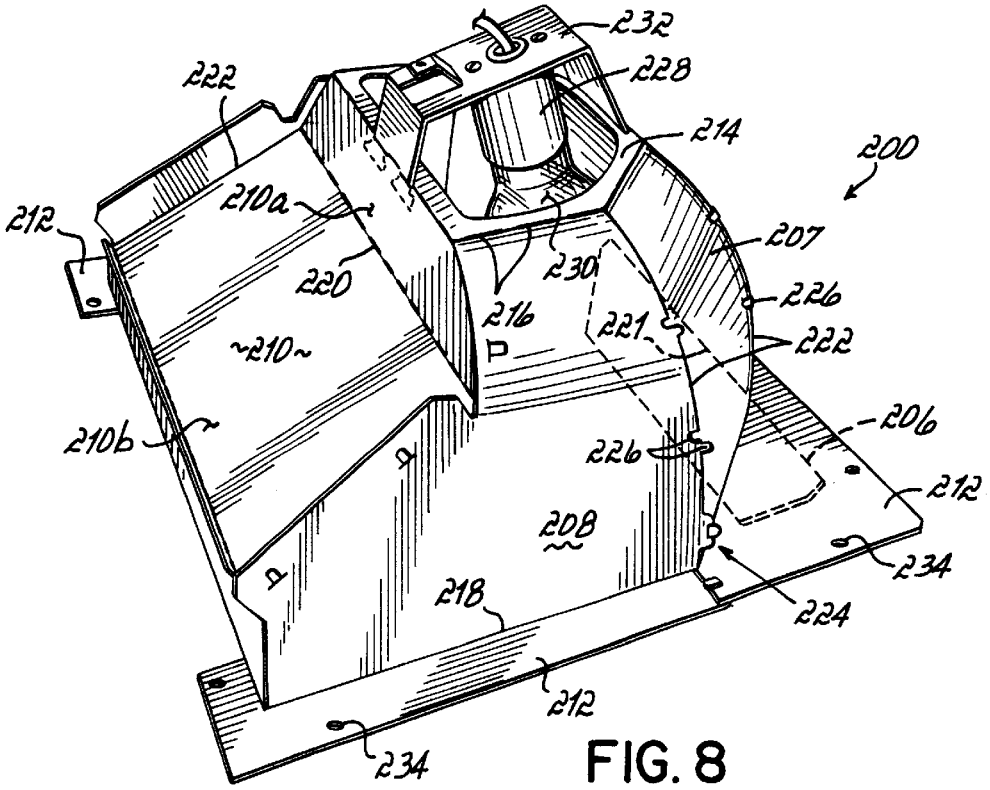
FIG. 8 is perspective view of yet another alternative reflector assembled in accordance with the principles of the present invention.
Figure 9:
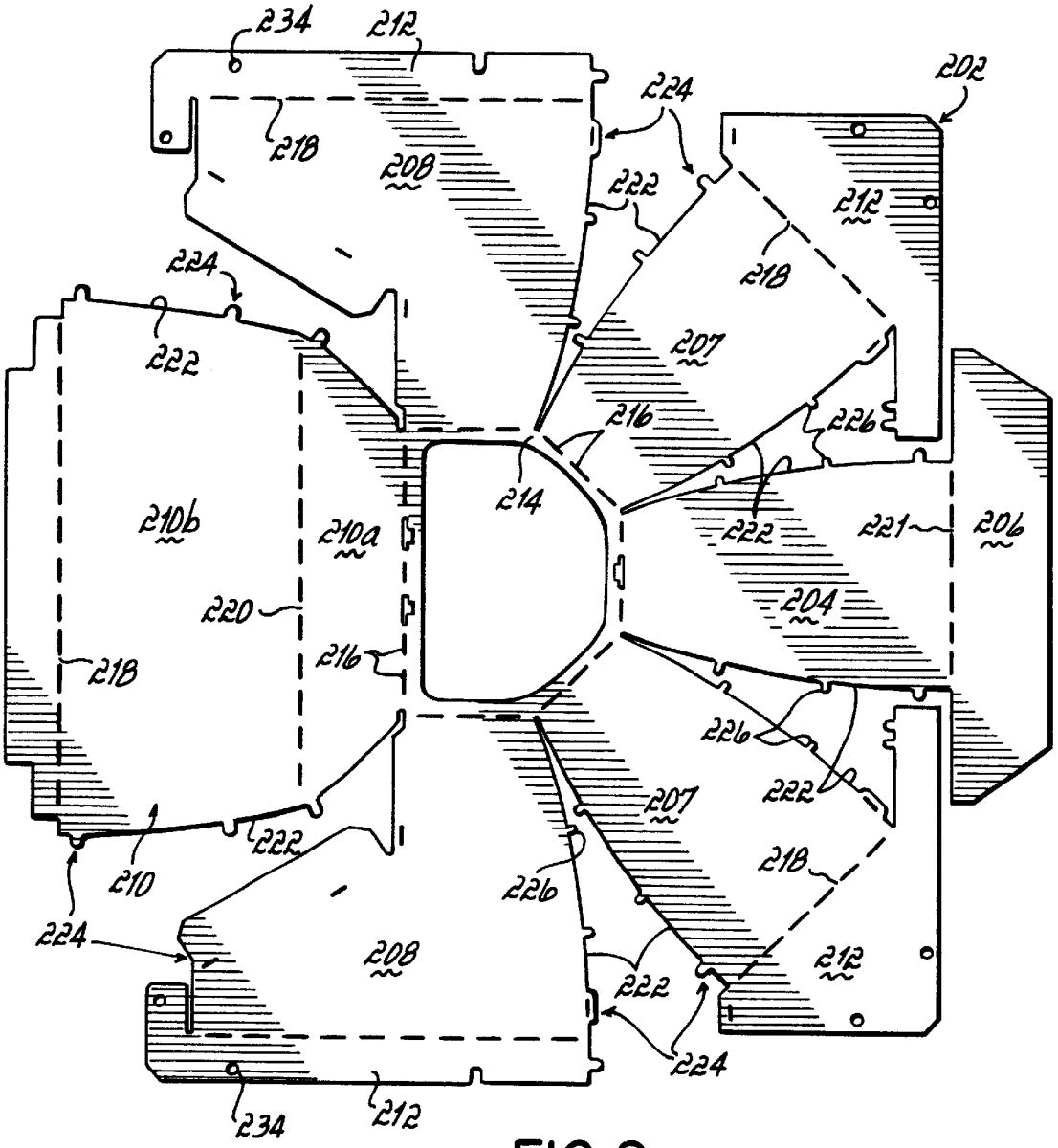
FIG. 9 is a top plan view of a sheet of reflective material that has been formed for making the assembled reflector illustrated in FIG. 8.

Another alternative embodiment of a self-supporting reflector 200 in accordance with the principles of the present invention is shown in FIGS. 8–9. Reflector 200 is formed from a sheet of reflective material 202 (FIG. 9) that includes integral rear panel 204 with a rear louver 206, corner panels 207, side panels 208, front panel 210, mounting flanges 212 and collar 214. The panels 204, 207, 208, 210, rear louver 206, and mounting flanges 212 are adapted to be folded and curved by hand to form the assembled reflector 200 shown in FIG. 8. Reflector 200 is a self-standing reflector that is particularly adapted to provide a "forward throw" light distribution pattern from the perimeter of an area to be illuminated.

As best understood with reference to FIG. 9, the panels 204, 207, 208 and 210 are joined to the collar 214 through fold line 216. Mounting flanges 212 are joined to corner panels 207 and side panels 208 through fold lines 218. Front panel 210 includes a fold line 220 to allow the front panel 210 to be folded into a pair of planar reflective surfaces 210*a*, 210*b* as shown in FIG. 8. A fold line 221 is provided to allow rear louver 206 to be folded by hand downwardly and inwardly from rear panel 204 to adjust the illumination pattern created by reflector 200.

Each of the panels 204, 207, 208 and 210 includes substantially non-linear free edges 222 and locking members 224 formed adjacent the free edges 222 to permit the panels to be folded and curved by hand and engaged in abutting relationship as shown in FIG. 8 to retain reflector 200 in its self-standing reflector shape. Panels 204, 207 and 208 also include positioning tabs 226 extending from free edges 222 to maintain abutting relationship of the free edges 222. A light socket 228 and light source 230 are supported on a bracket 232 to extend into the enclosed reflector 200 in a generally vertical orientation. As described in detail above, reflector 200 is adapted to be mounted within a luminaire housing (not shown) through fasteners (not shown) extending through apertures 234 formed in the mounting flanges 212.

Figure 10:
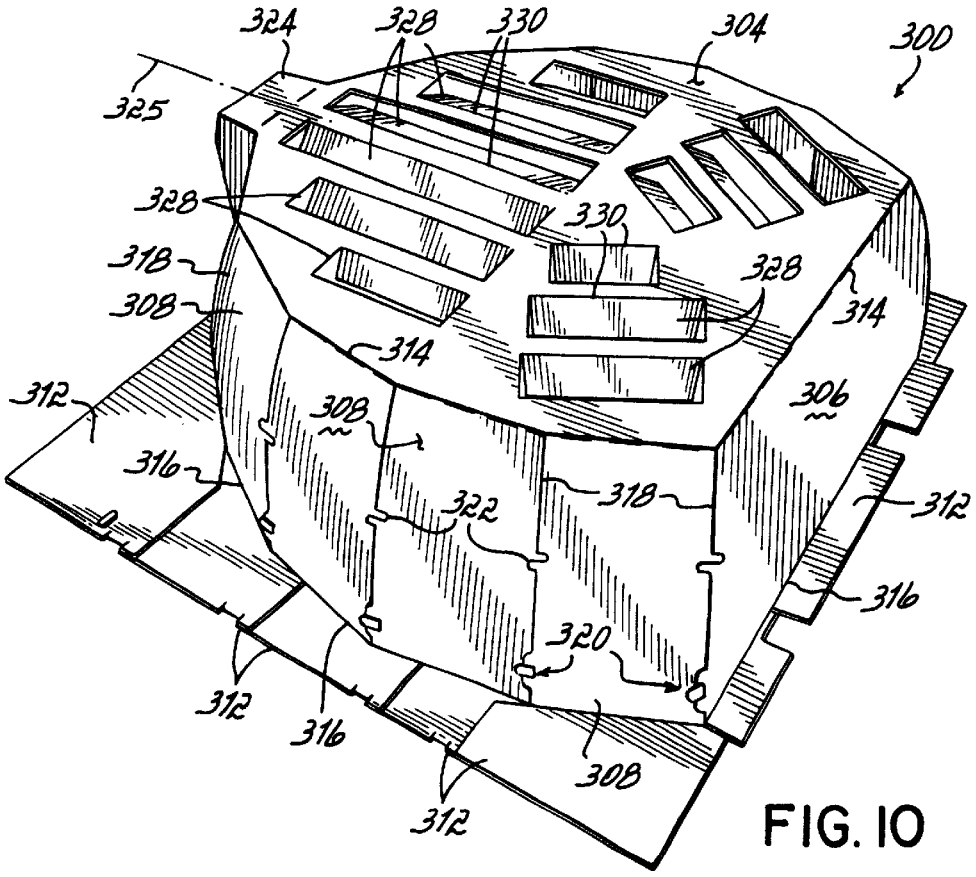
FIG. 10 is perspective view of still yet another alternative reflector assembled in accordance with the principles of the present invention.
Figure 11:
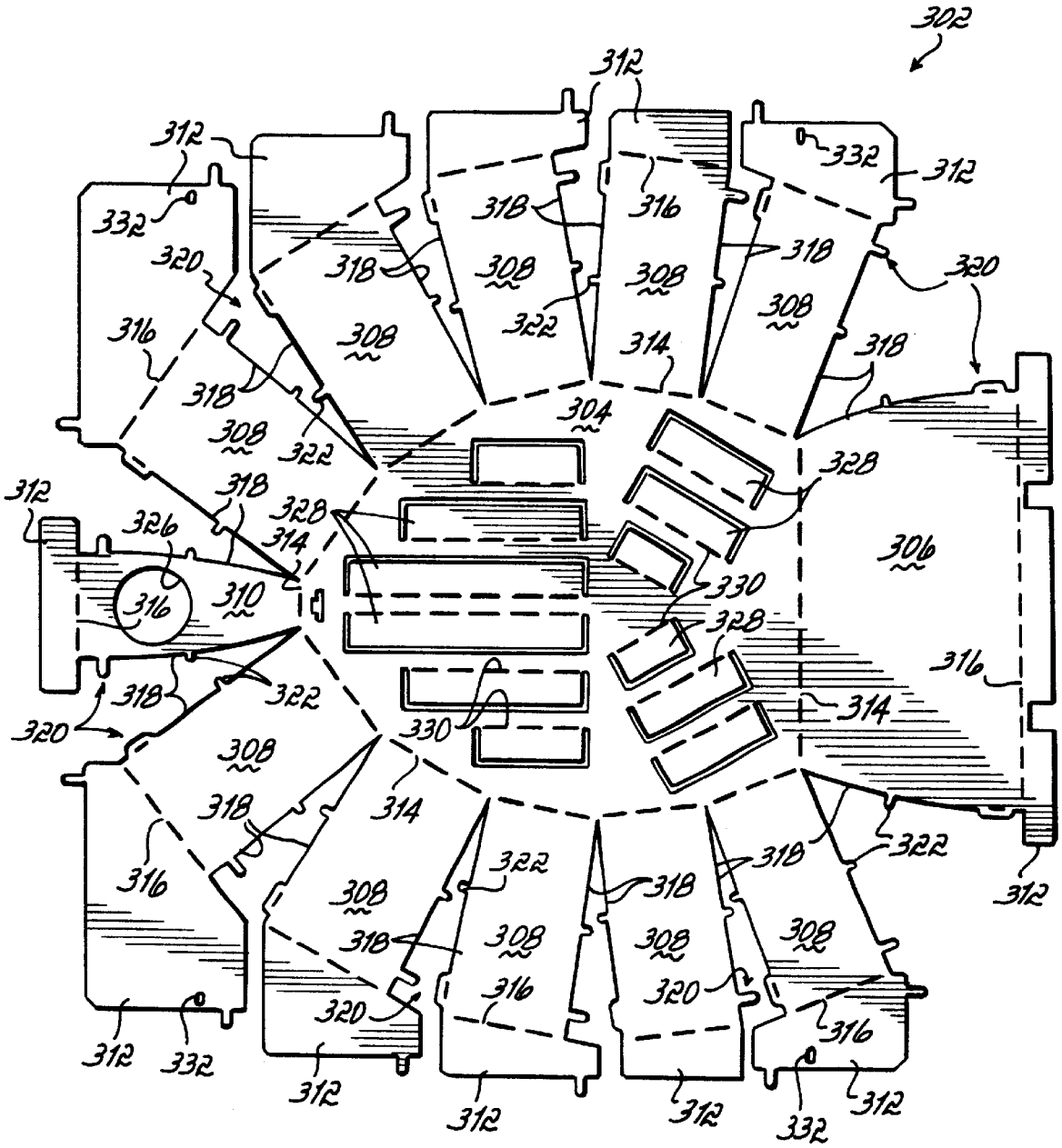
FIG. 11 is a top plan view of a sheet of reflective material that has been formed for making the assembled reflector illustrated in FIG. 10.

Yet another alternative embodiment of a self-supporting reflector 300 in accordance with the principles of the present invention is shown in FIGS. 10 and 11. Reflector 300 is formed from a sheet of reflective material 302 (FIG. 11) that includes integral top panel 304, front panel 306, side panels 308, rear panel 310, and mounting flanges 312. The panels 304, 306, 308 and 310, and mounting flanges 312 are adapted to be folded and/or curved by hand to form assembled reflector 300 shown in FIG. 10. As best understood with reference to FIG. 10, reflector 300 is an enclosed, self-standing reflector that is particularly adapted to provide a "Type III" light distribution pattern on a surface to be illuminated. A "Type III" light distribution pattern has generally oval symmetry around the luminaire.

The front panel 306, side panels 308 and rear panel 310 are joined to the top panel 304 through fold lines 314. Mounting flanges 312 are joined to panels 306, 308 and 310 through fold lines 316. Each of the panels 306, 308 and 310 includes substantially non-linear free edges 318 and locking members 320 formed adjacent the free edges 318 to permit the panels to be engaged in abutting relationship as shown in FIG. 10 to retain reflector 300 in its self-standing reflector shape. Each of the panels 306, 308 and 310 includes positioning tabs 322 extending from free edges 318 to maintain the abutting relationship of the free edges 318 as described in detail above.

As shown in FIG. 10, a bracket 324 is mounted to the reflector 300 to support a light socket (not shown) and light source (not shown) with their longitudinal axes 325 extending generally parallel to the top panel 304. An aperture 326 (FIG. 11) is formed in the rear panel 310 to allow the light socket (not shown) and light source (not shown) to extend into the enclosure formed by reflector 300. The top panel 304 includes louvers 328 that are joined to panel 304 through fold lines 330. The louvers 328 are folded downwardly by hand or by machine from the top panel 304 along fold lines 330 at different angles to extend into the enclosure formed by reflector 300. The louvers 328 are provided to modify the light distribution pattern created by reflector 300. The reflector 300 is also adapted to be mounted within a luminaire housing (not shown) through fasteners (not shown) extending through apertures 332 (FIG. 11) formed in the mounting flanges 312.

Figure 12A:
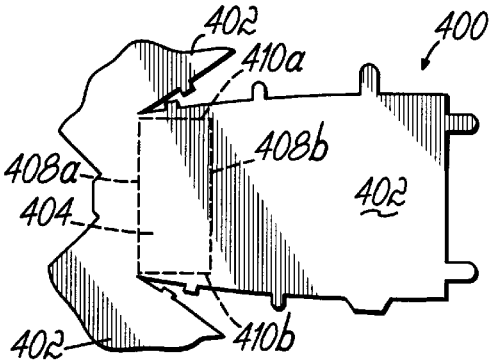
FIG. 12A is a partial top plan view of a sheet of reflective material including a backing member to define a predetermined fold line upon folding of the sheet by hand.
Figure 12B:
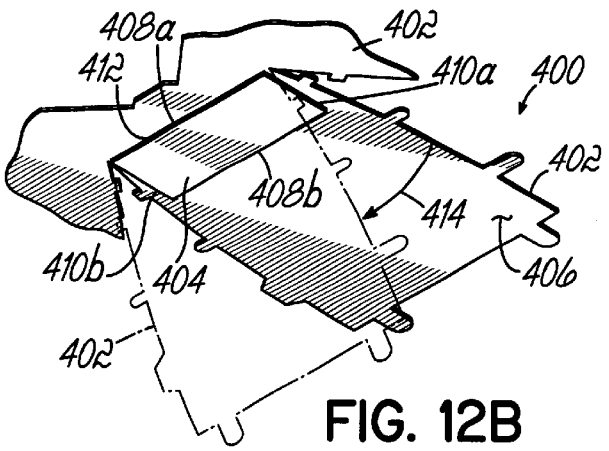
FIG. 12B is a partial bottom perspective view of the sheet of reflective material shown in FIG. 12A, illustrating folding of the sheet at the predetermined fold line.

In accordance with an alternative embodiment of the present invention, as shown in FIGS. 12A and 12B, a sheet of reflective material 400 includes integral panels 402 that generally lie in a common plane after formation of the sheet 400. At least one backing member 404, preferably made of relatively stiff sheet metal and having reflective properties, is attached or otherwise fastened to an inner surface 406 of the sheet 400. Backing member 404 is preferably planar and includes a pair of opposite elongated side edges 408*a*, 408*b* and a pair of end edges 410*a*, 410*b* (FIG. 12B). The backing member 404 engages sheet 400 and is positioned relative to the sheet 400 so that at least one of the elongated side edges 408*a*, 408*b* is coincident with a predetermined fold line or line of bending in the sheet 400 upon folding of the sheet 400 by hand.

For example, as shown in FIG. 12B, backing member 404 is positioned so that side edge 408*a* is coincident with a predetermined fold line or line of bending 412 associated with one of the panels 402. Upon folding of the panel 402 downwardly and inwardly by hand, as represented by arrow 414, the side edge 408*a* defines a consistent line of bending in the sheet 400 along the predetermined fold line 412 that is coincident with the side edge 408*a*.

It is contemplated that backing member 404 could be glued, riveted, screwed or attached by any other suitable fastening structure or material to the sheet 400. Additionally, while not shown, it is contemplated that the sheet 400 and backing member 404 may be provided with pins, detents, tabs, slots or any other suitable alignment structure that would aid in registering the backing member 404 relative to the sheet 400 so that at least one of the elongated side edges 408*a*, 408*b* is positioned accurately to lie coincident with the predetermined fold line or line of bending 412.

In an alternative embodiment, it is contemplated that backing member 404 could be configured as part of a hand-held tool (not shown) or, alternatively, as part of a work bench or table (not shown), for example. According to this embodiment, the backing member 404 and sheet 400 are positioned so that the backing member 404 operatively engages the sheet 400 and at least one of the elongated side edges 408*a*, 408*b* is positioned accurately to lie coincident with the predetermined fold line or line of bending 412. Upon folding of the panel 402 downwardly and inwardly by hand, at least one of the side edges 408*a*, 408*b* defines a consistent line of bending in the sheet along the predetermined fold line 412. After panel 402 has been folded to the desired position, either the backing member 404 is moved relative to the sheet 400 to the next predetermined fold line or, alternatively, the sheet 400 is moved relative to the backing member 404 for the next panel fold.

Figure 12C:
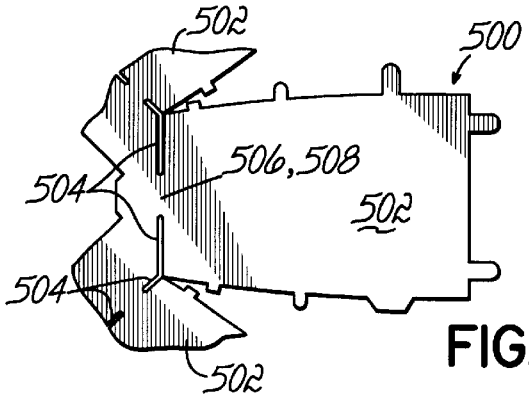
FIG. 12C is a view similar to FIG. 12A illustrating an alternative embodiment of a predetermined fold line in the sheet of reflective material.

Alternatively, as shown in FIG. 12C, a sheet of reflective material 500 includes integral panels 502 and elongated notches 504 that define a generally narrow connecting web 506 associated with at least one of the panels 502. Each connecting web 506 is preferably formed by a pair of opposing notches 504 of generally uniform width that extend along a generally common axis and through the thickness of the sheet 500. Upon folding of the panel 502 inwardly and downwardly by hand, it will be appreciated that the connecting web 506 defines a consistent line of bending in the sheet 500 that is coincident with a predetermined fold line 508 associated with the panel 502.

Therefore, it will be appreciated by those of ordinary skill in the art that use of backing member 404, in combination with sheet 400, or notches 504 in combination with connecting web 506, provides the ability to consistently and reliably define predetermined fold lines or lines of bending in the sheets 400 and 500, respectively, without otherwise treating or forming sheets 400 and 500 to include preformed fold lines as described above in connection with FIGS. 1–11.

Figure 13:
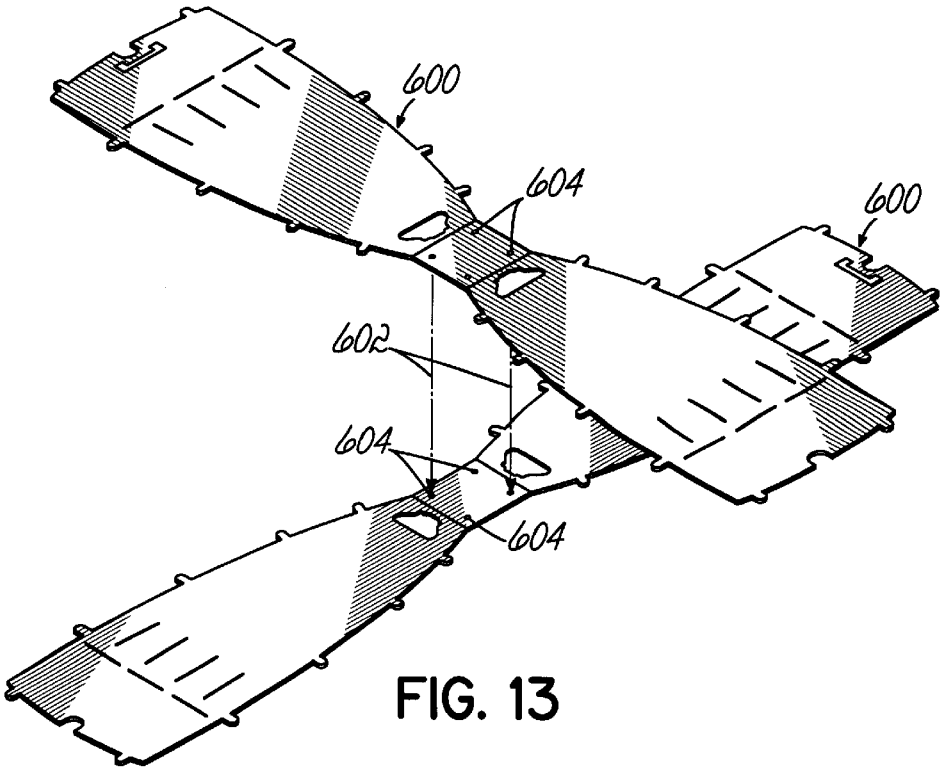
FIG. 13 is a disassembled perspective view of a pair of sheets of reflective material adapted to be joined together and folded by hand to form an assembled reflector in accordance with the principles of the present invention.

While a unitary single sheet of reflective material is preferred for forming self-standing reflectors in accordance with its principle of the present invention, it is contemplated that two or more sheets of reflective material may be joined together and folded to form a self-standing reflector as described below. For example, as shown in FIG. 13, two (2) identical sheets of reflective material 600 are adapted to be joined together, as indicated by arrows 602, and folded by hand into a self-standing reflector (not shown). It is contemplated that sheets 600 could be joined together by adhesives, rivets, screws or any other suitable fastening structure or material, as shown diagrammatically by numbers 604. Of course, it will be appreciated that in alternative embodiments, sheets 600 may not be identical, and more than two (2) sheets of reflective material may be joined together and folded by hand into a self-standing reflector in accordance with the principles of the present invention. Additionally, while not shown, it is contemplated that the sheets 600 may be provided with pins, detents, tabs, slots or any other suitable alignment structure that would aid in registering one of the sheets 600 relative to the other during the assembly process.

While the present invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. The invention in its broader aspects is therefore not limited to the specific details, representative apparatus and method, and illustrative examples shown and described. Accordingly, departures may be made from such details without departing from the spirit or scope of applicants' general inventive concept.

Having described the invention, what is claimed is:

1. A self-standing reflector for a luminaire having a light source securable therein and an opening through which light from the source is emitted, comprising:

a plurality of reflective panels formed from at least one sheet of reflective material and folded along fold lines pre-formed in said at least one sheet into abutting relationship to define a predetermined three-dimensional reflector shape, at least one of said panels being curved to define a curved reflective surface and having at least one free edge abutting adjacent a free edge of an abutting panel upon folding of said panels, wherein said curved panel has a discrete first locking member formed proximate the free edge thereof for locking engagement with a discrete second locking member formed proximate the free edge of said abutting panel, whereby said first and second locking members cooperate upon folding of said panels to retain said reflector in said predetermined three-dimensional reflector shape.

2. The reflector of claim 1 wherein at least one of said panels is joined to an adjacent panel through an associated fold line.

3. The reflector of claim 2 wherein said fold line comprises a plurality of elongated slots formed through the thickness of said at least one sheet of reflective material and aligned along said fold line.

4. The reflector of claim 1 wherein a pair of abutting panels each include at least one positioning tab extending outwardly from a free edge thereof to overlie said other abutting panel and maintain abutting relationship of said free edges.

5. The reflector of claim 1 wherein a pair of abutting panels each include a substantially non-linear free edge for abutting a substantially non-linear free edge of said other abutting panel.

6. The reflector of claim 1 wherein one of said first and second locking members comprises a locking tab and said other comprises a locking slot, wherein said locking tab is adapted to be inserted into said locking slot and form a locking engagement therebetween.

7. The reflector of claim 6 wherein said locking tab includes a detent member adapted to engage said locking slot upon insertion therein.

8. A self-standing reflector for a luminaire having a light source securable therein and an opening through which light from the source is emitted, comprising:

a plurality of reflective panels formed from at least one sheet of reflective material and folded into abutting relationship to define a predetermined three-dimensional reflector shape, wherein at least two of said panels are curved to define curved reflective surfaces and include substantially non-linear free edges abutting substantially non-linear free edges of abutting curved panels, whereby a substantially contiguous curved reflective surface is formed by said abutting curved panels.

9. The reflector of claim 8 wherein a pair of abutting panels each include at least one positioning tab extending outwardly from a free edge thereof to overlie said other abutting panel and maintain abutting relationship of said free edges.

10. The reflector of claim 8 wherein one of said first and second locking members comprises a locking tab and said other comprises a locking slot, wherein said locking tab is adapted to be inserted into said locking slot and form a locking engagement therebetween.

11. The reflector of claim 10 wherein said locking tab includes a detent member adapted to engage said locking slot upon insertion therein.

12. A self-standing reflector for a luminaire having a light source securable therein and an opening through which light from the source is emitted, comprising:

a plurality of reflective panels formed from at least one sheet of reflective material and folded into abutting relationship to define a predetermined three-dimensional reflector shape, wherein at least one of said panels has free edges abutting adjacent free edges of an abutting panel upon folding of said panels, said pair of abutting panels each including at least one positioning tab extending outwardly from a free edge thereof to overlie said other abutting panel and maintain abutting relationship of said free edges, and cooperating locking members formed proximate the free edges of said abutting panels to retain said reflector in said predetermined three-dimensional shape.

13. A luminaire assembly, comprising:

a luminaire housing;

a reflector mounted within said luminaire housing comprising a plurality of reflective panels formed from at least one sheet of reflective material and folded along fold lines pre-formed in said at least one sheet into abutting relationship to define a predetermined three-dimensional reflector shape, wherein at least one of said panels has free edges abutting adjacent free edges of an abutting panel upon folding of said panels, and cooperating discrete locking members formed proximate the free edges of said abutting panels to retain said reflector in said predetermined three-dimensional shape;

a light source socket disposed within said reflector; and a light source mounted within said socket for emitting light upon energizing said source to produce a predetermined light distribution pattern defined by said reflector shape.

14. The luminaire assembly of claim 13 further comprising a bracket mounted to said reflector for supporting said light source socket.

15. The luminaire assembly of claim 14 wherein said bracket includes a pair of spaced flanges joined by a central web, wherein said light source socket is mounted to said cental web and said pair of flanges are releasably securable to said reflector.

16. The luminaire assembly of claim 13 wherein at least one of said panels is joined to an adjacent panel through an associated fold line.

17. The luminaire assembly of claim 16 wherein said fold line comprises a plurality of elongated slots formed through the thickness of said sheet of reflective material and aligned along said fold line.

18. The luminaire assembly of claim 13 wherein at least some of said panels include at least one positioning tab extending outwardly from a free edge thereof to overlie an abutting panel and maintain abutting relationship of said free edges.

19. The luminaire assembly of claim 13 wherein at least two of panels include a substantially non-linear free edge for abutting adjacent a substantially non-linear free edge of an abutting panel.

20. A method of making a self-standing reflector for a luminaire, comprising:

forming a plurality of reflective panels from at least one sheet of reflective material;

folding at least one of said panels by hand along a fold line pre-formed in said at least one sheet;

curving at least one of said panels by hand to define a curved reflective surface;

folding said curved panel along a fold line pre-formed in said at least one sheet;

abutting a free edge of said curved panel adjacent a free edge of an abutting folded panel; and locking said curved panel into engagement with said abutting folding panel through direct locking cooperation of said curved panel and said abutting folding panel.

21. The method of claim 20 wherein said forming step comprises die cutting said at least one sheet of reflective material.

22. The method of claim 20 wherein said locking step comprises:

forming a first locking member proximate the free edge of said curved panel;

forming a second locking member proximate the free edge of said abutting folded panel; and locking said first and second locking members.

23. The method of claim 20 further comprising:

forming a pair of panels;

forming at least one substantially non-linear free edge on each of said pair of panels; and adjacently abutting said substantially non-linear edges of said panels by folding said panels into abutting relationship.

24. The method of claim 23 further comprising:

forming at least one positioning tab extending outwardly from the substantially non-linear free edges of said pair of panels; and folding said pair of panels whereby said positioning tab of one of said abutting panel overlies the other abutting panel.

25. A method of making a self-standing reflector for a luminaire, comprising:

forming a plurality of reflective panels from at least one sheet of reflective material;

forming substantially non-linear free edges on at least two of said panels to be curved;

curving at least two of said panels by hand to define curved reflective surfaces; and adjacently abutting said substantially non-linear edges of said curved panels to form a substantially contiguous curved reflective surface.

26. The method of claim 25 further comprising locking said curved panels into engagement.

27. The method of claim 25 wherein said forming step comprises die cutting said at least one sheet of reflective material in a single die press operation.

28. The method of claim 25 further comprising:

forming at least one positioning tab extending outwardly from the substantially non-linear free edges of said curved panels; and folding said curved panels whereby said positioning tab of one of said curved panels overlies an abutting curved panel.

29. A method of forming a luminaire assembly, comprising:

providing a luminaire housing;

providing at least one sheet of reflective material;

forming a plurality of reflective panels from said at least one sheet of reflective material;

folding at least one of said panels by hand along a fold line pre-formed in said at least one sheet;

curving at least one of said panels by hand to define a curved reflective surface;

folding said curved panel along a fold line pre-formed in said at least one sheet;

abutting a free edge of said curved panel adjacent a free edge of an abutting folded panel;

locking said curved panel into direct locking engagement with said abutting folded panel to define a reflector;

mounting said reflector in said housing;

providing a light source socket disposed within said reflector; and mounting a light source within said socket for emitting light upon energizing said source to produce a predetermined light distribution pattern.

30. A self-standing reflector for a luminaire having a light source securable therein and an opening through which light from the source is emitted, comprising:

a plurality of reflective panels formed from at least one sheet of reflective material and folded along predetermined lines of bending in said at least one sheet into abutting relationship to define a predetermined three-dimensional reflector shape, at least one of said panels being curved to define a curved reflective surface and having at least one free edge abutting adjacent a free edge of an abutting panel upon folding of said panels, wherein said curved panel has a discrete first locking member formed proximate the free edge thereof for locking engagement with a discrete second locking member formed proximate the free edge of said abutting panel, whereby said first and second locking members cooperate upon folding of said panels to retain said reflector in said predetermined three-dimensional reflector shape.

31. A luminaire assembly, comprising:

a luminaire housing;

a reflector mounted within said luminaire housing comprising a plurality of reflective panels formed from at least one sheet of reflective material and folded along predetermined lines of bending in said at least one sheet into abutting relationship to define a predetermined three-dimensional reflector shape, wherein at least one of said panels has free edges abutting adjacent free edges of an abutting panel upon folding of said panels, and cooperating discrete locking members formed proximate the free edges of said abutting panels to retain said reflector in said predetermined three-dimensional shape;

a light source socket disposed within said reflector; and a light source mounted within said socket for emitting light upon energizing said source to produce a predetermined light distribution pattern defined by said reflector shape.

32. A method of making a self-standing reflector for a luminaire, comprising:

forming a plurality of reflective panels from at least one sheet of reflective material;

folding at least one of said panels by hand along a predetermined line of bending in said at least one sheet;

curving at least one of said panels by hand to define a curved reflective surface;

folding said curved panel along a predetermined line of bending in said at least one sheet;

abutting a free edge of said curved panel adjacent a free edge of an abutting folded panel; and locking said curved panel into engagement with said abutting folding panel through direct locking cooperation of said curved panel and said abutting folding panel.

33. A self-standing reflector for a luminaire having a light source securable therein and an opening through which light from the source is emitted, comprising:

a plurality of reflective panels formed from at least one sheet of reflective material and folded along predetermined lines of bending in said at least one sheet into abutting relationship to define a predetermined three-dimensional reflector shape; and a plurality of backing members connected to said at least one sheet, each of said backing members having an edge defining one of the predetermined lines of bending in said at least one sheet.

34. A method of making a self-standing reflector for a luminaire, comprising:

forming a plurality of reflective panels from at least one sheet of reflective material;

operatively engaging a backing member with said at least one sheet so that an elongated edge of said backing member is positioned to lie coincident with a predetermined line of bending in said sheet; and folding at least one of said panels by hand along said predetermined line of bending defined by said backing member.

* * * * *